US011393430B2

(12) United States Patent
Nagasaki et al.

(10) Patent No.: US 11,393,430 B2
(45) Date of Patent: Jul. 19, 2022

(54) LIGHT EMISSION APPARATUS AND ELECTRONIC DEVICE

(71) Applicant: CANON KABUSHIKI KAISHA, Tokyo (JP)

(72) Inventors: Mizuki Nagasaki, Kanagawa (JP); Hiromasa Tsuboi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/319,216

(22) Filed: May 13, 2021

(65) Prior Publication Data

US 2021/0375233 A1 Dec. 2, 2021

(30) Foreign Application Priority Data

May 28, 2020 (JP) ..... JP2020-093676

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/041* (2013.01); *G09G 2320/0646* (2013.01); *G09G 2330/028* (2013.01)

(58) Field of Classification Search
CPC ..... G09G 5/10
See application file for complete search history.

(56) References Cited

U.S. PATENT DOCUMENTS

| | | | | |
|---|---|---|---|---|
| 10,818,232 | B2 | 10/2020 | Tsuboi et al. | |
| 10,867,561 | B2 | 12/2020 | Ota et al. | |
| 10,998,392 | B2 | 5/2021 | Tsuboi | |
| 2018/0293944 | A1* | 10/2018 | Kim | G09G 3/3275 |
| 2020/0126481 | A1 | 4/2020 | Tsuboi | |
| 2020/0143741 | A1 | 5/2020 | Tsuboi et al. | |
| 2020/0258966 | A1* | 8/2020 | Cha | H01L 27/1225 |
| 2021/0005142 | A1 | 1/2021 | Tsuboi et al. | |
| 2021/0111227 | A1 | 4/2021 | Tsuboi | |

FOREIGN PATENT DOCUMENTS

JP 2011-141346 A 7/2011

OTHER PUBLICATIONS

Machine translation of JP 2011-141346.*

* cited by examiner

*Primary Examiner* — Gustavo Polo
(74) *Attorney, Agent, or Firm* — Venable LLP

(57) ABSTRACT

A light emission apparatus is provided. The apparatus comprises a plurality of pixels that each include a light emission element, and a signal supply unit that supplies to each of the plurality of pixels a signal voltage that accords with inputted image data. Each of the plurality of pixels comprises a first transistor configured to control an amount of current that flows in the light emission element, and a second transistor disposed between a signal line on which the signal voltage is supplied and a gate electrode of the first transistor and, in an on state, write in the gate electrode the signal voltage. The signal supply unit adjusts the signal voltage in accordance with a frame rate.

23 Claims, 11 Drawing Sheets

LIGHT EMISSION APPARATUS AND ELECTRONIC DEVICE

BACKGROUND OF THE INVENTION

Field of the Invention

The present invention relates to a light emission apparatus and an electronic device.

Description of the Related Art

Light emission apparatuses that use, as light emission elements, organic EL (electroluminescent) elements, which emit light at a luminance that accords with current flowing in the elements are known. Japanese Patent Laid-Open No. 2011-141346 describes a display apparatus in which a pixel circuit that includes a drive transistor for supplying current that accords with a signal voltage to a light emission element and a sampling transistor for inputting the signal voltage into a gate of the drive transistor are disposed.

There are cases where due to leakage current when the sampling transistor is off, the signal voltage inputted into the drive transistor changes which changes the light emission luminance of the light emission element. Because the amount of leakage current may change depending on operation conditions and the usage environment when the light emission apparatus is operated, there is a possibility that light emission luminance related to the same signal voltage will change according to the change in the operation conditions and usage environment. In a case where light emission luminance changes in relation to the same signal voltage, it becomes difficult to maintain image quality.

SUMMARY OF THE INVENTION

The present invention aims to provide a technique that is advantageous for preventing degradation of image quality in a light emission apparatus.

According to some embodiments, a light emission apparatus comprising a plurality of pixels that each include a light emission element, and a signal supply unit that supplies to each of the plurality of pixels a signal voltage that accords with inputted image data, each of the plurality of pixels further comprising: a first transistor configured to control an amount of current that flows in the light emission element; and a second transistor disposed between a signal line on which the signal voltage is supplied and a gate electrode of the first transistor and, in an on state, write in the gate electrode the signal voltage, wherein the signal supply unit adjusts the signal voltage in accordance with a frame rate, is provided.

According to some other embodiments, a light emission apparatus comprising a plurality of pixels that each include a light emission element, and a signal supply unit that supplies to each of the plurality of pixels a signal voltage that accords with inputted image data, each of the plurality of pixels comprising: a first transistor configured to control an amount of current that flows in the light emission element; and a second transistor disposed between a signal line on which the signal voltage is supplied and a gate electrode of the first transistor and, in an on state, write in the gate electrode the signal voltage, wherein the signal supply unit adjusts the signal voltage in accordance with a temperature of the light emission apparatus and in a case of a second temperature whose temperature is higher than a first temperature, increases an offset amount related to the signal voltage that accords with the image data more than in a case of the first temperature, is provided.

According to still other embodiments, a light emission apparatus that includes a plurality of pixels that each include a light emission element, and a signal supply unit that supplies to each of the plurality of pixels a signal voltage that accords with inputted image data, each of the plurality of pixels further comprising: a first transistor configured to control an amount of current that flows in the light emission element; and a second transistor disposed between a signal line on which the signal voltage is supplied and a gate electrode of the first transistor and, in an on state, write in the gate electrode the signal voltage, wherein the light emission apparatus further comprises: a third transistor configured to estimate leakage current in an off state of the second transistor, wherein the signal supply unit, in accordance with the leakage current of the third transistor for when the third transistor is operated, adjusts the signal voltage, is provided.

Further features of the present invention will become apparent from the following description of exemplary embodiments with reference to the attached drawings.

DESCRIPTION OF THE EMBODIMENTS

Figure 1:
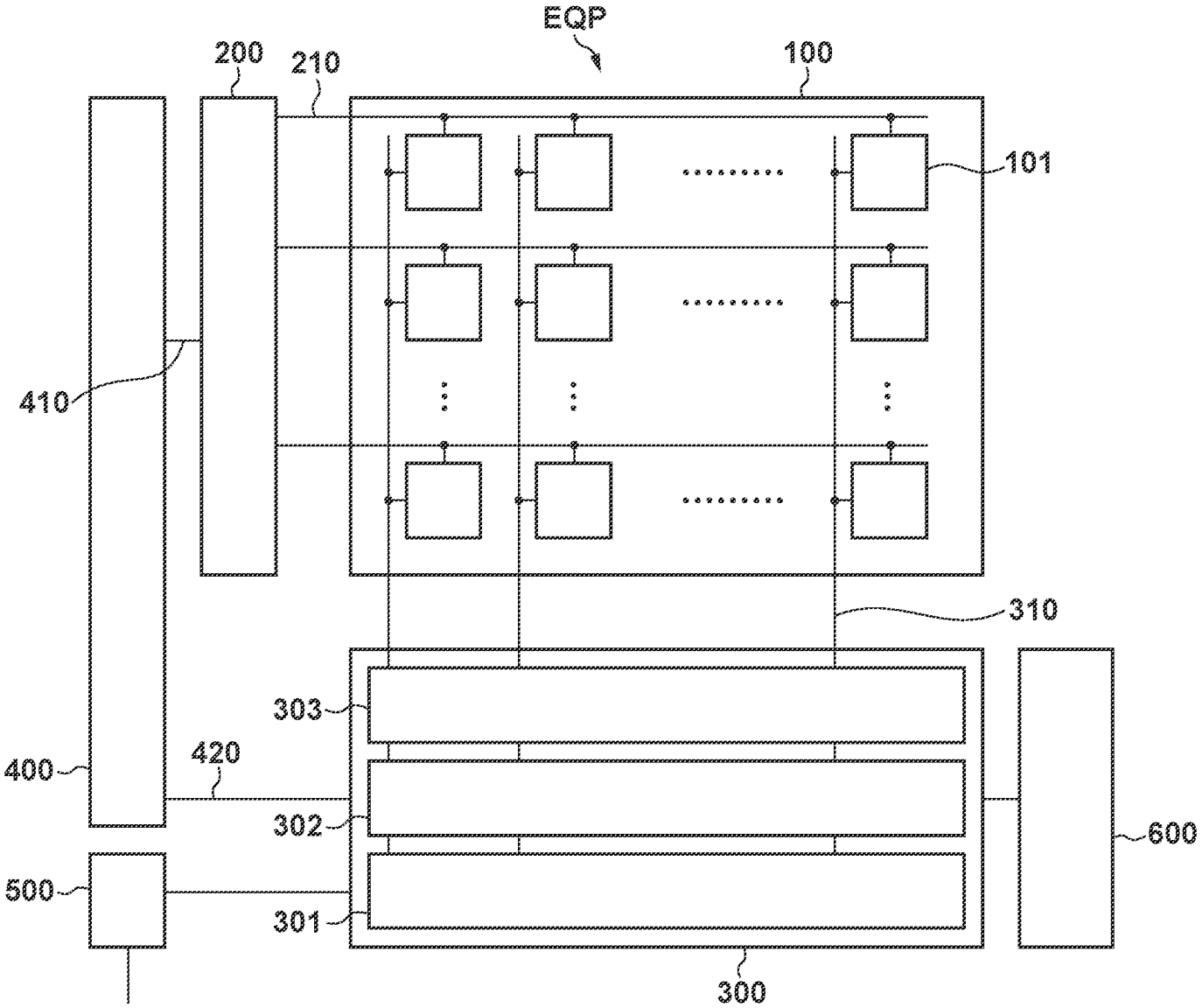
FIG. 1 is a view illustrating an example of a configuration of a light emission apparatus in the present embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

A light emission apparatus according to an embodiment of the present disclosure will be described with reference to FIGS. 1 to 7. FIG. 1 is a view illustrating an example of a configuration of a light emission apparatus EQP of a first embodiment of the present disclosure. The light emission apparatus EQP includes a pixel array 100, a vertical scanning circuit 200, a signal output circuit 300, a control circuit 400, a data processing circuit 500, and a reference voltage generation circuit 600. The signal output circuit 300, which is an output unit that outputs signals, and the reference voltage generation circuit 600, which is a reference voltage generation unit that generates reference voltages Vref (details will be described later), constitute a signal supply unit.

A plurality of pixels 101 are disposed across a plurality of rows and a plurality of columns (a two-dimensional array) in the pixel array 100. Regarding each of the pixels 101, control signals are inputted via a scanning line 210 from the vertical scanning circuit 200 and a luminance signal voltage Vsig, which is an image signal, is inputted via a signal line 310 from the signal output circuit 300. Image data for displaying images is inputted into the data processing circuit 500 from outside the light emission apparatus EQP, and the digitally processed image data is outputted to the signal output circuit 300. The vertical scanning circuit 200 and the signal output circuit 300 are controlled by the control circuit 400. Each of the plurality of pixels 101 comprises a light emitting diode (a light emission element) and emits light of an amount of light emission that corresponds to the luminance signal voltage Vsig to be inputted. Here, each of the pixels 101 may have a plurality of sub-pixels disposed for each color, and in such a case, the signal line 310 is provided for each column with respect to each sub-pixel. For example, in a case where three sub-pixels are included in one pixel, three signal lines 310 may be provided for one pixel column.

The signal output circuit 300, which is an output unit, has a horizontal scanning circuit 301, a column DAC circuit 302 disposed across a plurality of columns, and a column driver circuit 303 disposed across a plurality of columns. In the present embodiment, one column DAC circuit 302 and one column driver circuit 303 correspond. The image data to be scanned and then inputted into each column by the horizontal scanning circuit 301 is converted into an analog voltage by the column DAC circuit 302 and then is outputted to the pixels 101 via the signal lines 310 from the column driver circuit 303 as the signal voltage Vsig, which represents luminance. The reference voltage generation circuit 600, which is a reference voltage generation unit, generates and then supplies to the column DAC circuit 302 a plurality of analog reference voltages Vref that accord with the number of tones of the image data (e.g., in a case where the image data is 8 bits, 256 analog voltages). Here, among the reference voltages Vref, a voltage that represents the highest luminance is a voltage V1 and a voltage that represents the lowest luminance is a voltage V2. Also, the reference voltage generation circuit 600 may generate a reference voltage V0, which is used to correct variabilities of the signal output circuit 300 and the pixels 101. At this time, the reference voltage V0 may be supplied to the pixels 101 via the column driver circuit 303 and the signal lines 310. The output voltages Vout of the column driver circuit 303 are the signal voltage Vsig and the reference voltage V0 and are supplied to the pixels 101 via the signal lines 310 in sequence. As described above, the signal voltage Vsig that accords with the image data inputted into the light emission apparatus EQP is supplied to each of the plurality of pixels 101 by the signal supply unit, which includes the signal output circuit 300, which is an output unit, and the reference voltage generation circuit 600, which is a reference voltage generation unit.

Figure 2:
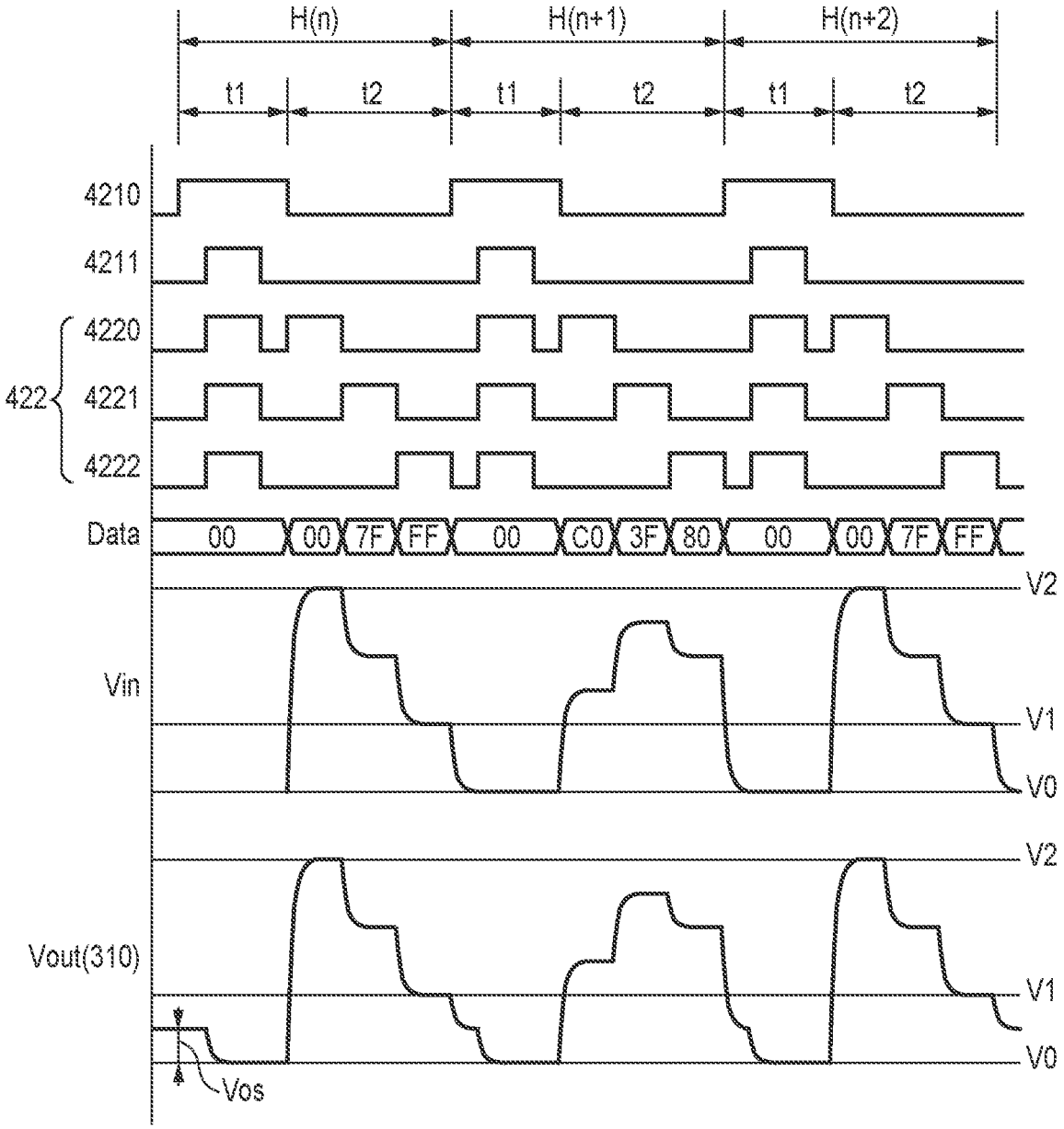
FIG. 2 is a timing chart describing an operation of the light emission apparatus of FIG. 1.

FIG. 2 is a timing chart describing an operation of the light emission apparatus EQP. H(n) indicates a horizontal scan period of an nth row and includes an offset cancellation period t1 and a signal write period t2.

In the period t1, a reference signal control pulse 4210 becomes active, and the reference voltage V0 is set for the input voltage Vin of the column driver circuit 303. Because the column driver circuit 303 has a different offset voltage Vos for each column, the output voltages Vout of the column driver circuit 303 take on values which are the offset voltages Vos added to the reference voltage V0, which is an input voltage. The output voltages Vout of the column driver circuit 303 are supplied to the pixels 101 via the signal lines 310 when signal line selection pulses 422 become active.

Next, the column driver circuit 303 stores a different offset voltage Vos for each column in accordance with a variability correction control pulse 4211, and then variability correction processing is performed. The output voltages Vout of the column driver circuit 303, because the influence of the voltages Vos is suppressed, take on values close to the reference voltage V0, which is an input voltage. Also, at this time, the signal line selection pulses 422 become active, the column driver circuit 303 and the pixels 101 are connected via the signal lines 310, and although it is not illustrated, processing for correcting the variabilities of the pixels 101 is also performed.

Here, regarding the column DAC circuit 302 and the column driver circuit 303, each one may correspond to one sub-pixel column or to a plurality of sub-pixel columns. In the present embodiment, assume that each one of the column DAC circuit 302 and the column driver circuit 303 corresponds to three sub-pixel columns.

Next, in the period t2, the reference signal control pulse 4210 becomes inactive, and the signal voltage Vsig, which was converted in the column DAC circuit 302 in accordance with image data Data, is set for the input voltage Vin of the column driver circuit 303. By the signal line selection pulses 422, an output of the column driver circuit 303 is connected with one signal line 310 that accords with a column address of the image data.

Figure 3:
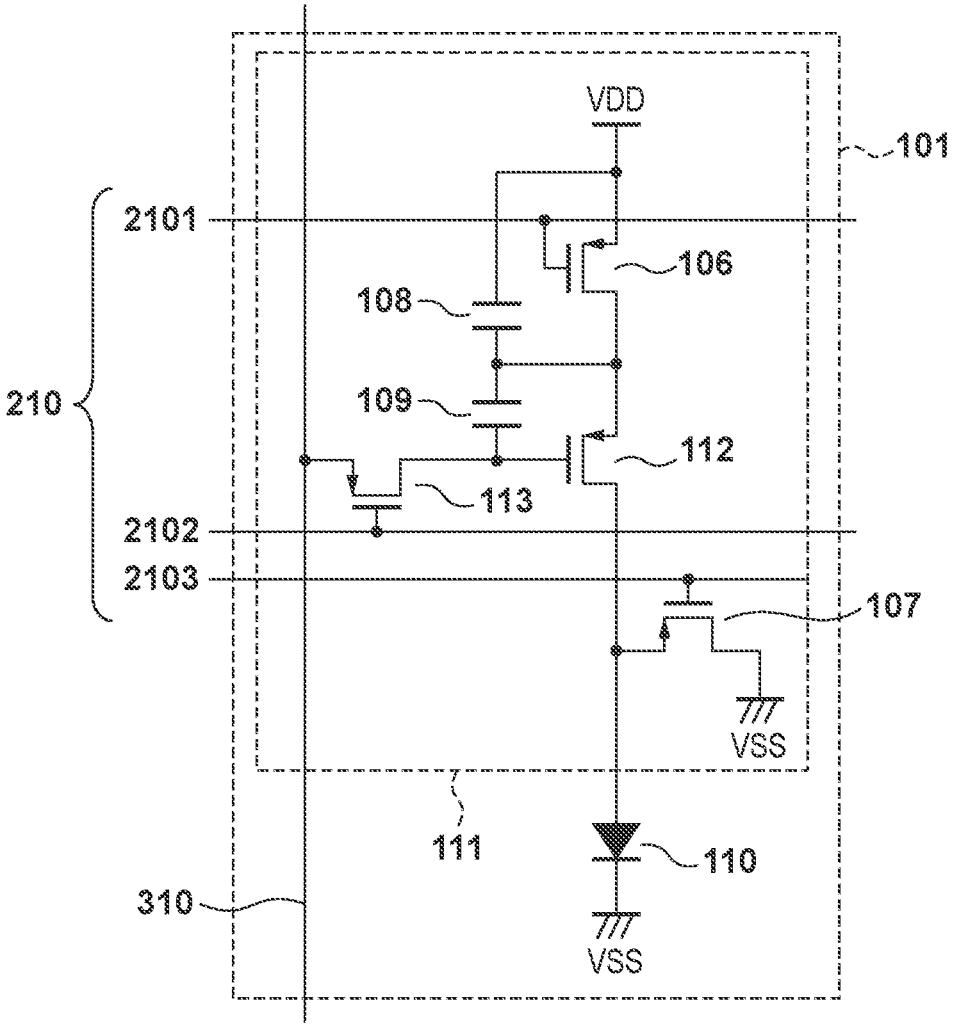
FIG. 3 is an equivalent circuit diagram illustrating an example of a configuration of a pixel of the light emission apparatus of FIG. 1.

FIG. 3 is an equivalent circuit diagram illustrating an example of a pixel 101 that the light emission apparatus EQP has. Hereinafter, a case where the drive transistor is connected to a positive electrode of a light emission element and transistors are all P-type transistors will be described; however, the light emission apparatus of the present invention is not limited to this.

As illustrated in FIG. 3, the pixel 101 includes a light emission element 110, a drive transistor 112, a write transistor 113, a light emission control transistor 106, a reset transistor 107, a capacitive element 108, and a capacitive element 109. One (the drain in the configuration of FIG. 3) of the main terminals of the drive transistor 112, which controls the amount of current flowing in the light emission element 110, is connected to one electrode of the light emission element 110. Another electrode of the light emission element 110 is connected to a power source wiring line VSS (electric potential Vss).

The write transistor 113 is disposed between the signal line 310 in which the signal voltage Vsig is supplied and the gate electrode of the drive transistor 112 and, in an on state, writes the signal voltage Vsig into the gate electrode of the drive transistor 112. More specifically, one of the main electrodes of the write transistor 113 is connected to the gate of the drive transistor 112 and another is connected to the signal line 310. The gate electrode of the write transistor 113 is connected to a write signal 2102.

One (a drain in the configuration of FIG. 3) of the main electrodes of the light emission control transistor 106, which controls emission or non-emission of the light emission element 110, is connected to another main electrode of the drive transistor 112. Another (a source in the configuration of FIG. 3) main electrode of the light emission control transistor 106 is connected to a power source wiring line VDD (electric potential Vdd). The gate of the light emission control transistor 106 is connected to a light emission control signal 2101.

One (the source in the configuration of FIG. 3) of the main electrodes of the reset transistor 107, which resets the voltage applied to the light emission element 110, is connected to one of the main electrodes of the drive transistor 112 (the drain in the configuration of FIG. 3). Another (the drain in the configuration of FIG. 3) main electrode of the reset transistor 107 is connected to a power source wiring line VSS. The gate electrode of the reset transistor 107 is connected to a reset signal 2103.

The capacitive element 108 is connected between the source of the drive transistor 112 and the power source wiring line VDD. The capacitive element 109 is connected between the gate and the source of the drive transistor 112.

Figure 4:
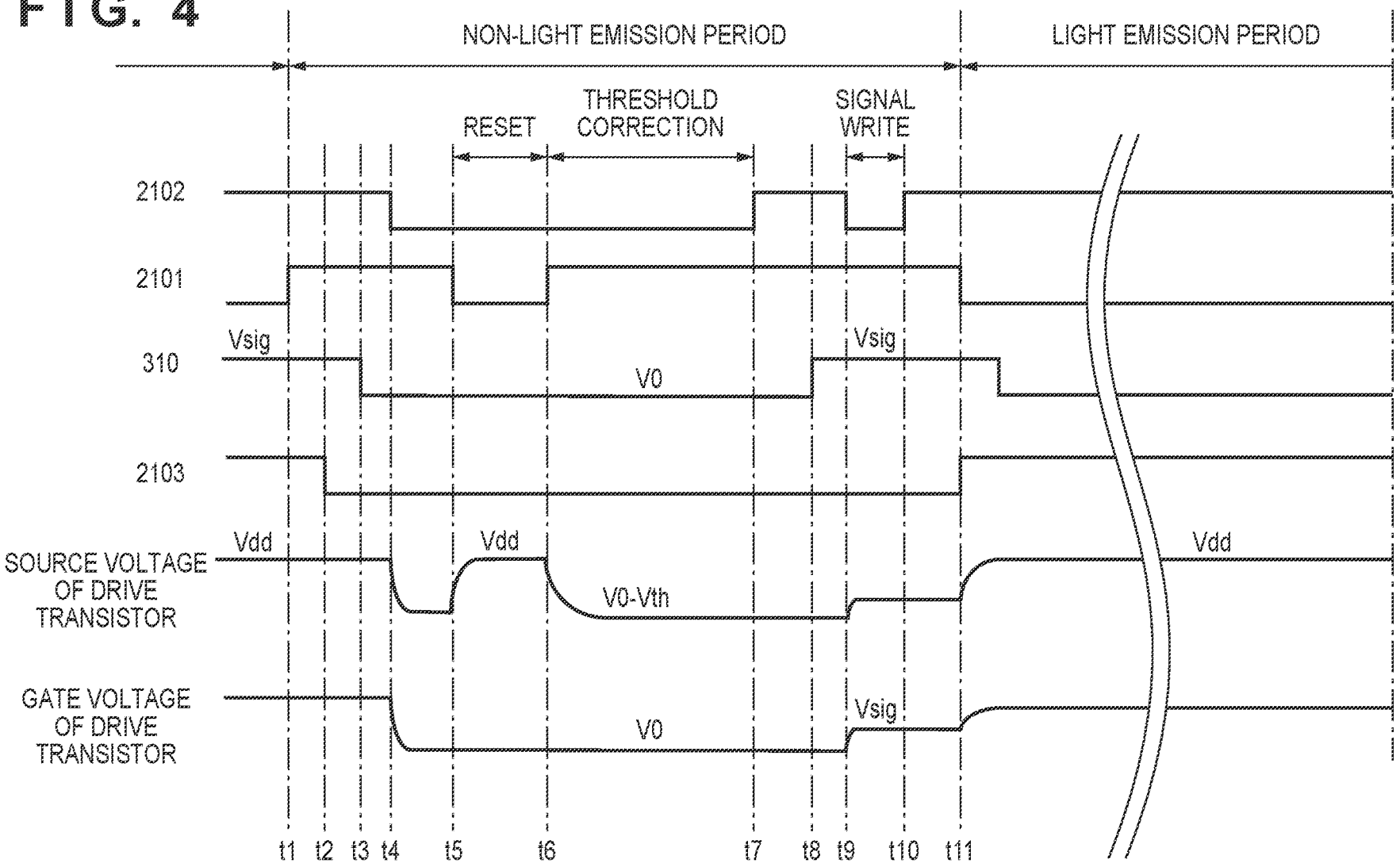
FIG. 4 is a timing chart describing an operation of the light emission apparatus of FIG. 1.

FIG. 4 is a timing chart describing an operation of the pixel 101 in the present embodiment. This timing chart is a timing chart for a case where the light emission apparatus EQP is driven, for example, at a frame rate of 60 Hz and a chip temperature of 40 degrees (40° C.).

In the timing chart of FIG. 4, what is prior to time t1 is a light emission period of the light emission element 110 in the previous frame. In the light emission period, the light emission control transistor 106 enters an on state and the write transistor 113 and the reset transistor 107 enter an off state. The period from times t1 to t11 is one horizontal scan period, and the time t11 onward is a new frame.

First, at the time t1, current is stopped from being supplied to the light emission element 110 via the light emission control transistor 106 and the drive transistor 112 from the power source wiring line VDD due to the light emission control transistor 106 entering an off state, and then the light emission element 110 ceases to emit light. Also, by the time the light emission element 110 ceases to emit light, the source potential of the drive transistor 112 and the gate potential of the drive transistor 112, which is connected via the source of the drive transistor 112 and the capacitive element 109, decrease.

Next, at the time t2, current flows between the source of the drive transistor 112 and the power source wiring line VSS due to the reset transistor 107 entering an on state. At this time, because the light emission control transistor 106 is in an off state, the source potential and the gate potential of the drive transistor 112 and the electric potential of an electrode of the light emission element 110 (a positive electrode in the configuration of FIG. 3) decrease. The positive electrode of the light emission element 110 and the drain of the drive transistor 112 take on the same electric potential Vss as the power source wiring line VSS.

At the time t3, the electric potential of the signal line 310 switches to the reference voltage V0 from the signal voltage Vsig. As described above, the reference voltage V0 may be supplied via the signal output circuit 300 from the reference voltage generation circuit 600.

Next, at the time t4, the reference voltage V0 of the signal line 310 is written into the gate electrode of the drive transistor 112 via the write transistor 113 due to the write transistor 113 entering an on state. When the write transistor 113 is in an on state, a sufficiently low voltage is applied to the gate electrode of the write transistor 113, and the write transistor 113 operates in a linear region. By this, the write transistor 113 functions as a switch, and a voltage that is the same as the reference voltage V0 is applied from the signal line 310 to the gate electrode of the drive transistor 112.

At the time t5, the light emission control transistor 106 enters an on state again. By this, current flows to the power source wiring line VSS via the drive transistor 112 and the reset transistor 107 from the power source wiring line VDD. In the present embodiment, a sufficiently low voltage is applied to the gate electrode of the light emission control transistor 106, and the light emission control transistor 106 is set to operate in a linear region and function as a switch. Accordingly, when the drive transistor 112 is in an on state, an electric potential that is approximately the same as the power source wiring line VDD is applied to the source of the drive transistor 112. By this, the electric potential of the gate electrode of the drive transistor 112 also increases; however, because the reset transistor 107 is in an on state, the electric potential of the positive electrode of the light emission element 110 barely increases. As described above, the period in which the gate potential of the drive transistor 112 is initialized to the reference voltage V0 is a reset period. At this time, the electric potential of the source of the drive transistor 112 is approximately the electric potential Vdd.

Next, at the time t6, due to the light emission control transistor 106 entering an off state, the electric potential of the source of the drive transistor 112 changes to an electric potential (V0−Vth), which is a threshold voltage Vth of the drive transistor 112 subtracted from the reference voltage V0, from the electric potential Vdd of the power source wiring line VDD. By this, the threshold voltage Vth of the drive transistor 112 is held in the capacitive element 109. As described above, in each of the pixels 101, a period (a period from the time t6 to time t7) in which the threshold voltage Vth of the drive transistor 112 is taken on as a gate-source voltage of the drive transistor 112 (here, held in the capacitive element 109) is a threshold correction period. By this, the light emission control transistor 106 functions as a threshold correction unit, which compensates for the threshold voltage of the drive transistor 112. In the example illustrated in FIG. 3, the light emission control transistor 106 and the capacitive element 109 function as the threshold correction units.

At the time t7, the write transistor 113 enters an off state. Next, at the time t8, the electric potential of the signal of the signal line 310 is switched to the signal voltage Vsig from the reference voltage V0 by the signal output circuit 300.

At the time t9, the signal voltage Vsig which is the luminance signal is written into the gate electrode of the drive transistor 112 via the write transistor 113 due to the write transistor 113 entering an on state. As described above, the period in which the electric potential of the gate electrode of the drive transistor 112 is set to the signal voltage Vsig, which represents the luminance of the light emission element, is a signal write period.

Next, at the time t10, the write transistor 113 enters an off state again. At the time t11, current is supplied to the light emission element 110 via the drive transistor 112 from the power source wiring line VDD due to the light emission control transistor 106 entering an on state and the reset transistor entering an off state. By this, the electric potential of the positive electrode of the light emission element 110 transitions to an electric potential that accords with the signal voltage Vsig from the electric potential Vss, and then the light emission element 110 emits light. Also, current that flows in the drive transistor 112 becomes constant regardless of variability in the threshold of the drive transistor 112 of each pixel 101 by the processing for correcting the threshold from the time t6 to the time t7 so long as the luminance signal voltage Vsig is the same. By this, it is possible to realize a high-quality display.

One cycle of a light emission drive operation is performed as described using FIG. 4 in the above; however, the following point becomes a problem. As described above, regarding a pixel drive circuit operation, light is emitted after the signal voltage Vsig is written into the capacitive element 109. In the light emission period, the write transistor 113 is made to be in an off state. However, the voltage that is held in the capacitive element 109 may change due to the leakage current of the write transistor 113 in an off state flowing into the gate electrode of the drive transistor 112. Accordingly, there is a possibility that the gate-source voltage of the drive transistor 112 will change, the driving current of the light emission element 110 fluctuates, and light emission luminance cannot be maintained at a constant.

Figure 5:
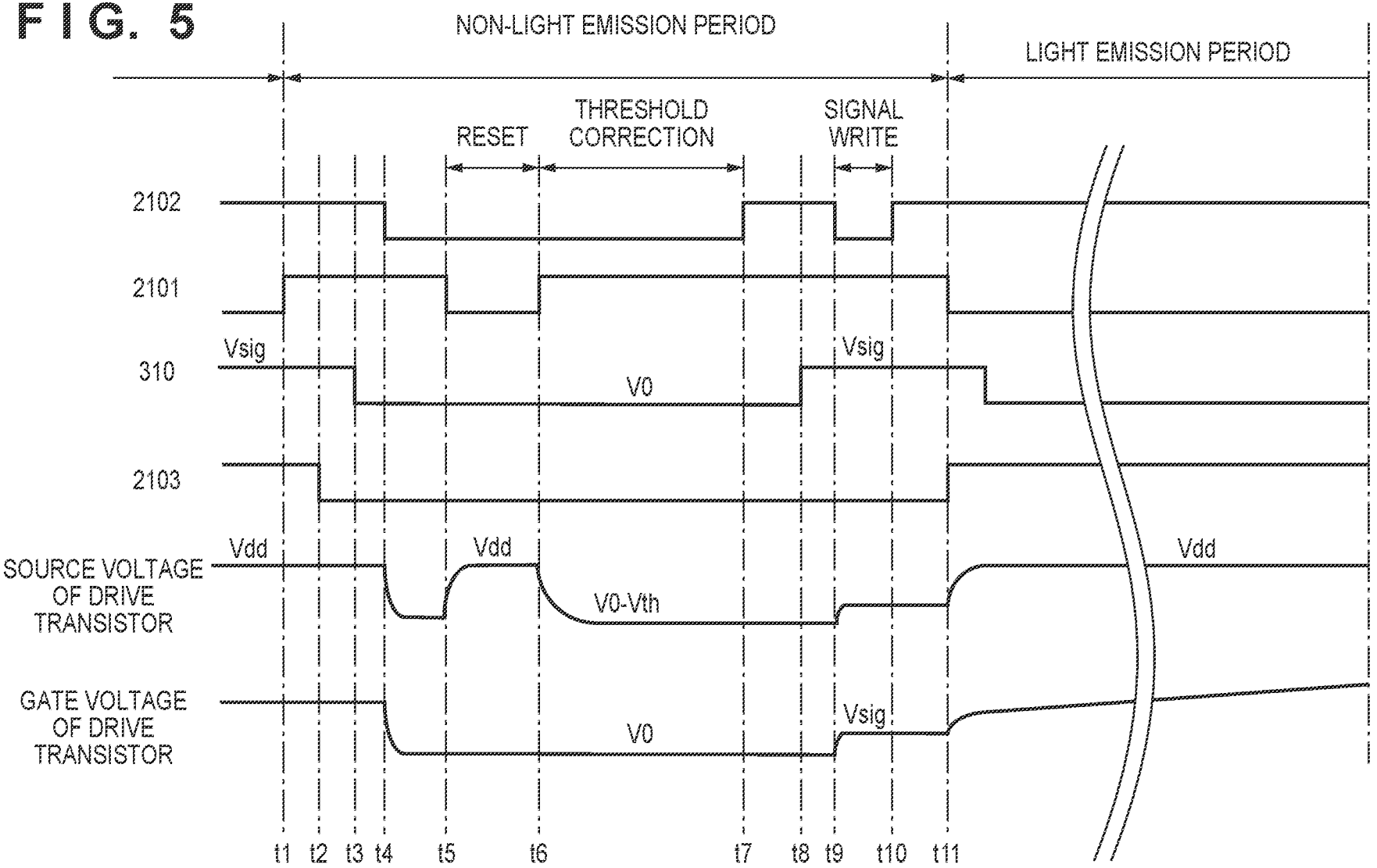
FIG. 5 is a timing chart describing an operation of the light emission apparatus of FIG. 1.

FIG. 4 illustrates an ideal state in which there is no leakage current of the write transistor 113; however, in reality, fluctuation in a gate voltage Vg of the drive transistor 112 occurs due to leakage current in the light emission period as illustrated in FIG. 5. Accordingly, in a case where, for example, the frame rate for when an image is displayed is changed, an average electric potential that the capacitive element 109 holds changes. As a result, a change that accords with the frame rate occurs to the luminance of the light emission element 110.

Figure 6:
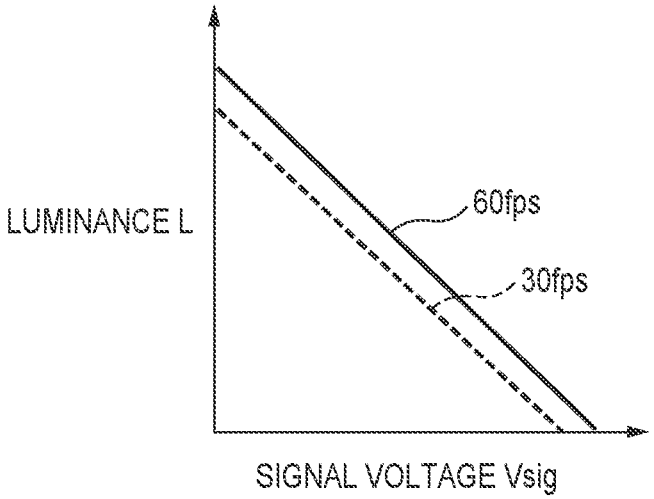
FIG. 6 is a view illustrating luminance characteristics of a pixel of the light emission apparatus of FIG. 1.

FIG. 6 is a graph illustrating a relationship (V-L characteristics) between the signal voltage Vsig, which represents the luminance of the light emission apparatus EQP, and actual luminance L of the light emission element 110. The horizontal axis is the luminance signal voltage Vsig, and the vertical axis is the luminance L. A case of two kinds of frame rates, 30 Hz and 60 Hz, as parameters are disclosed. As is clear from FIG. 6, regarding the signal voltage Vsig, 30 Hz driving is smaller than 60 Hz even in a case where the same luminance L is to be acquired. As described above, in a case where the frame rate is switched, if no measure is taken, the V-L characteristics of the light emission apparatus EQP will be different, and in a case where the same signal voltage Vsig is applied, deviation occurs in the luminance of a screen. In order to reduce the change in V-L characteristics due to the difference in the frame rates, reduction of leakage current of the write transistor 113 and an increase in the capacitive element 109 of the pixels 101 can be considered. However, the size of the pixels 101 in the light emission apparatus EQP is miniaturized year by year, and the difficulty of correcting the change in V-L characteristics is high and also leads to an increase in development cost.

Figure 7:
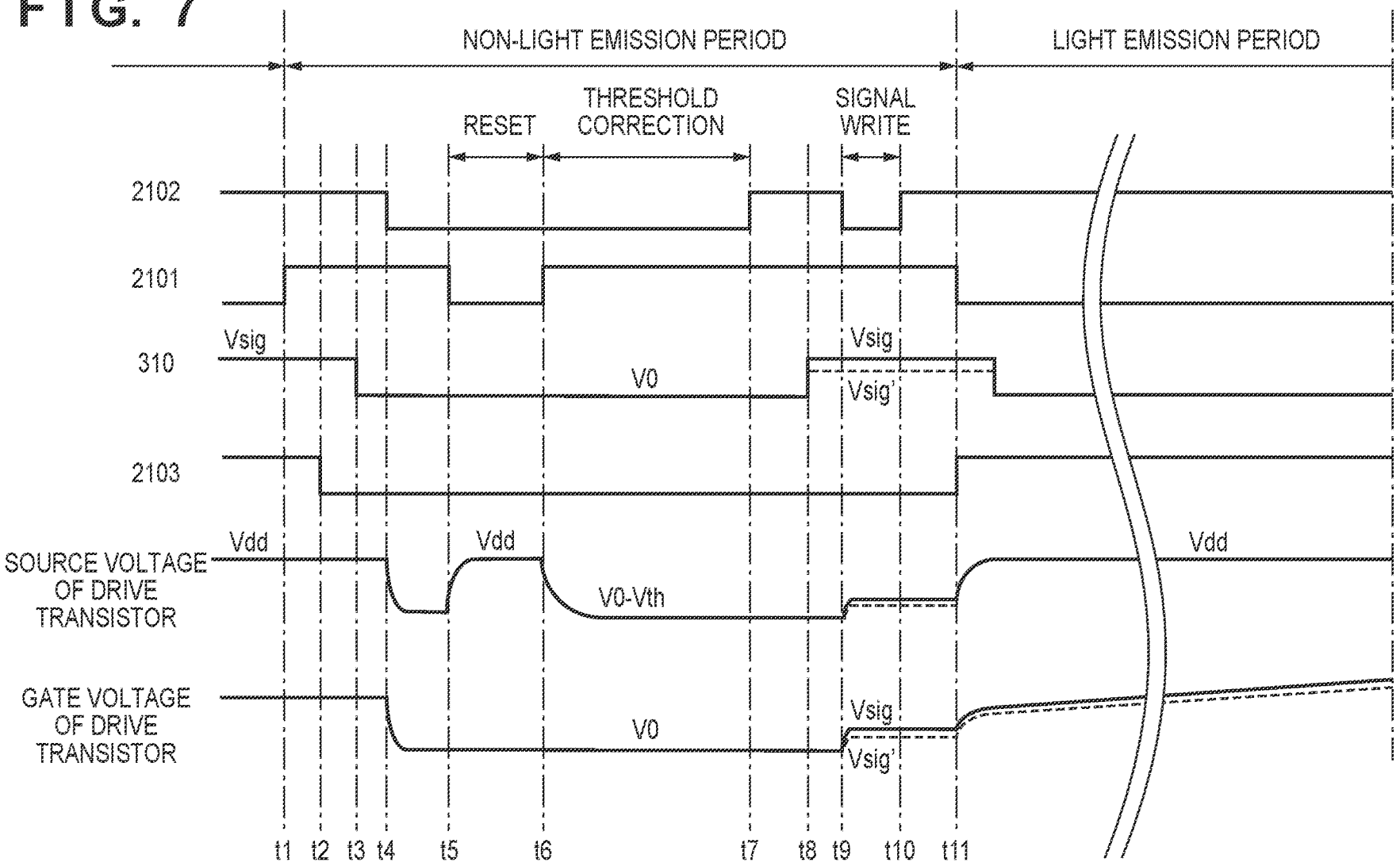
FIG. 7 is a timing chart describing an operation of the light emission apparatus of FIG. 1.

FIG. 7 is a timing chart describing an operation of the light emission apparatus EQP in the present embodiment. In order to facilitate understanding, the same notation has been used as the timing chart illustrated in FIG. 5. In FIG. 7, timings for a case where driving is performed at a frame rate of 30 Hz in addition to a case where driving is performed at a frame rate of 60 Hz of FIG. 5 are indicated.

In a case where the frame rate is 30 Hz, a period in which the capacitive element 109 holds the gate voltage of the drive transistor 112 is longer than a case where the frame rate is 60 Hz. Accordingly, in order to adjust the average luminance, the signal supply unit, which includes the signal output circuit 300 and the reference voltage generation circuit 600 adjusts the signal voltage Vsig in accordance with the frame rate as controlled by the control circuit 400. More specifically, as illustrated in FIG. 7, the signal voltage that is related to the image data inputted into the light emission apparatus EQP is changed from the signal voltage Vsig for a case of 60 Hz driving to, in a case of 30 Hz driving, a signal voltage Vsig'. The signal voltage Vsig' is set to a value that is lower than the signal voltage Vsig. In the present embodiment, the lower the selected frame rate, the lower the level of the signal voltage Vsig is adjusted. In other words, it can be said that in a case of the second frame rate whose frame rate is lower than the first frame rate, an offset amount related to the signal voltage Vsig that accords with the image data is more increased than the first frame rate. Also, it can be said that in a case of the second frame rate whose frame rate is lower than the first frame rate, the light emission element 110 is adjusted to emit light at a luminance that is higher than a luminance of the light emission element 110 in a case of the first frame rate. By this, the luminance for when displaying an image can be prevented from changing in accordance with the frame rate due to the leakage current of the write transistor 113. As a result, in the light emission apparatus EQP, it becomes possible to prevent image quality from degrading depending on the operation conditions and usage environment when operating the light emission apparatus EQP.

In the present embodiment, the lower the selected frame rate, the lower the level of the signal voltage Vsig is adjusted, but the invention is not limited to this. Depending on the operation sequence of the light emission apparatus EQP, there may be cases where the lower the frame rate becomes, the more the level of the signal voltage Vsig is increased. In any case, luminance characteristics are made to be maintained by appropriately changing the level of the signal voltage Vsig in accordance with the selected frame rate.

In the present embodiment, an example in which the control circuit 400 that controls the level of the signal voltage Vsig is disposed within the light emission apparatus EQP is described; however, the light emission apparatus EQP is not limited to this. For example, in a case where the light emission apparatus EQP is comprised by another apparatus as a display unit, the control circuit 400 may be disposed outside the light emission apparatus EQP.

A more specific method for adjusting the luminance that accords the frame rate will be described below as a second embodiment of the light emission apparatus EQP. Here, points of difference from the above first embodiment will be mainly described, and description will be omitted for points that may be the same.

Figure 8:
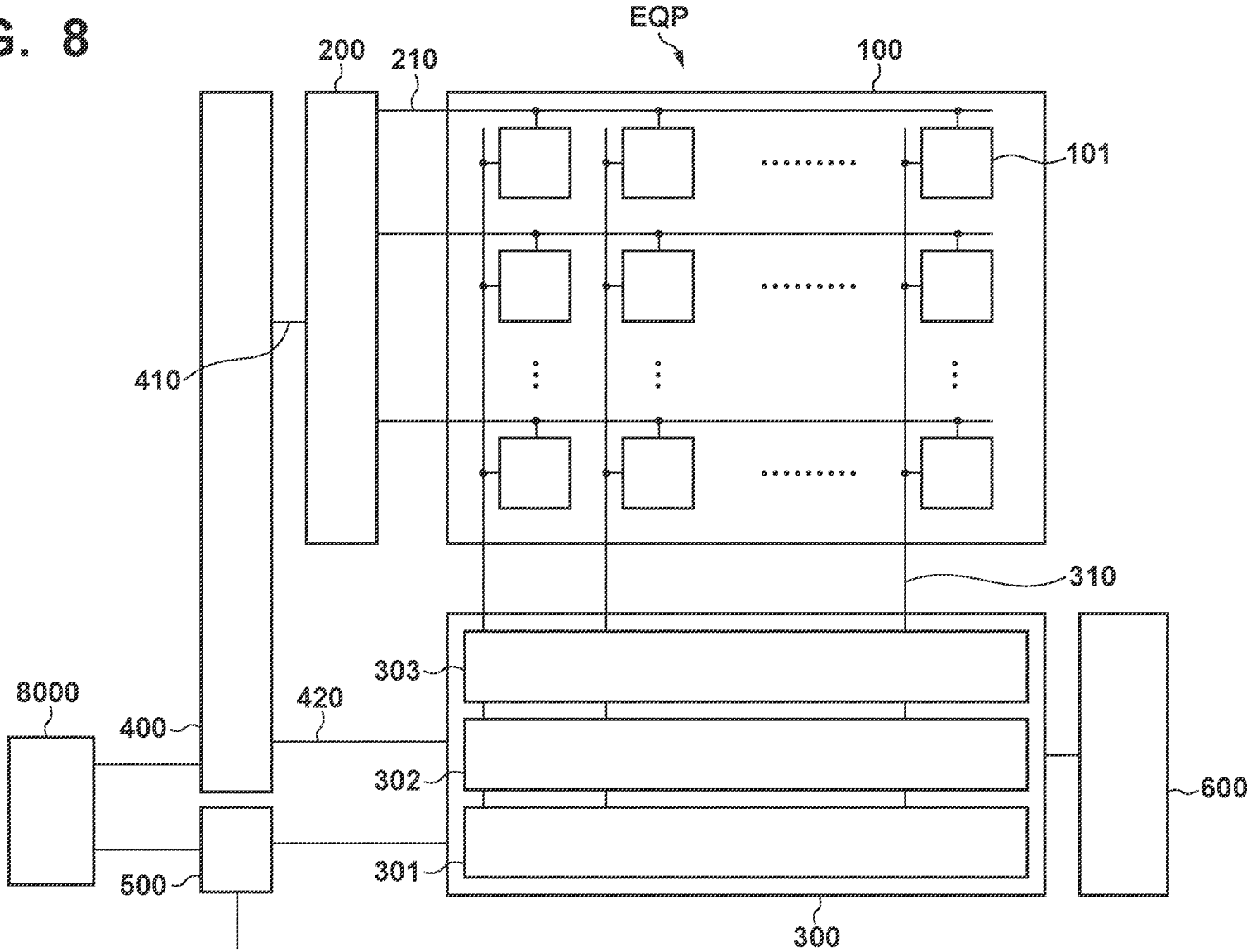
FIG. 8 is a view illustrating an example of providing a function that corrects luminance of the light emission apparatus of FIG. 1.

FIG. 8 is a schematic view illustrating an example of a configuration of the light emission apparatus EQP in the present embodiment. A correction circuit 8000, which constitutes a correction unit for correcting image data supplied to the light emission apparatus EQP has been added in relation to the light emission apparatus EQP of FIG. 1. The correction circuit 8000 is configured by a frame rate setting unit and a table memory (a correction value memory), which stores correction values that accord the frame rate. The table memory stores the correspondence relationship of different frame rates and correction values, outputs the correction value that corresponds to the frame rate that was set in the frame rate setting unit to the data processing circuit 500, and performs display setting.

As specific display setting, setting such as contrast and brightness can be given. Digital signal processing such as gamma correction, contrast adjustment, brightness adjustment are performed by the data processing circuit 500 on the image data inputted from outside the light emission apparatus EQP. Here, in the present embodiment, the correction circuit 8000 and the data processing circuit 500 constitute the correction unit. It can be said that the correction circuit 8000 in the correction unit includes a table memory (correction value memory) that stores correction values that accord with frame rates, and the data processing circuit 500 in the correction unit applies the correction value to the image data in accordance with the frame rate. Also, it can be said that the above signal supply unit further includes the correction unit that includes the correction circuit 8000 and the data processing circuit 500.

Digital-to-analog conversion is performed by the signal output circuit 300 on the image data on which the digital signal processing was performed, and then the signal voltage Vsig is written into the gate electrode of the drive transistor 112 of the pixels 101. In other words, adjustment of the signal voltage Vsig can be performed by adjusting the contrast or brightness in accordance with the correction value of the table memory. For example, the correction unit (the correction circuit 8000 and the data processing circuit 500), in a case of the second frame rate whose frame rate is lower than the first frame rate, may correct the luminance of the image data to a luminance that is higher than a luminance of the image data in a case of the first frame rate.

In the present embodiment, the luminance for when displaying an image can be prevented from changing in accordance with the frame rate due to the leakage current of the write transistor 113. As a result, in the light emission apparatus EQP, it becomes possible to prevent image quality from degrading depending on the operation conditions and usage environment for when operating the light emission apparatus EQP.

A more specific method for adjusting the luminance that accords the frame rate will be described below as a third embodiment of the light emission apparatus EQP. Here, points of difference from the above first and second embodiment will be mainly described, and description will be omitted for points that may be the same.

With the adjustment method described in the above second embodiment, because correction of image data is performed by digital signal processing, the number of tones that the light emission apparatus EQP can represent is limited. For example, if contrast is doubled in image data that was represented in 1024 tones, the image data can be represented only in 512 tones. Accordingly, in the present embodiment, by adjusting the signal voltage Vsig using an analog voltage, the limitation of the number of tones can be resolved.

Specifically, the reference voltage generation circuit 600, which is the reference voltage generation unit, generates a plurality of reference voltages Vref that accords with the number of tones of the image data and then supplies the column DAC circuit 302, which constitutes the output unit. The column DAC circuit 302 converts the image data to an analog voltage and supplies the result as the signal voltage Vsig to the signal lines 310 via the column driver circuit 303, which constitutes the output unit. In other words, by adjusting the analog reference voltage Vref of the reference voltage generation circuit 600, the signal voltage Vsig can be adjusted.

As described above, the reference voltage generation circuit 600 generates a plurality of reference voltages in a range of voltages between the voltage V1 and the voltage V2 whose luminance of the light emission element 110 is lower than the voltage V1. For example, in a case of performing display of 1024 tones, the reference voltage generation circuit 600 generates voltages, which are the range of voltages between the voltage V1 and the voltage V2 divided into 1024, as respective reference voltages Vref. In a case of adjusting luminance in accordance with the frame rate, configuration may be such that only the voltage V1 is adjusted, for example. For example, configuration may be such that in the case of the second frame rate whose frame rate is lower than the first frame rate, the light emission element 110 changes the voltage V1 to a voltage to emit light at a luminance that is higher than a luminance of the light emission element 110 in a case of the first frame rate. However, because in a case of adjusting only the voltage V1, a gamma characteristic of the light emission apparatus EQP will deteriorate, configuration may be such that not only the voltage V1 but also the voltage V2 is be adjusted at the same time. For example, configuration may be such that in the case of the second frame rate whose frame rate is lower than the first frame rate, the light emission element 110 changes the voltage V2 to a voltage to emit light at a luminance that is higher than a luminance of the light emission element 110 in a case of the first frame rate. At this time, for example, the range of voltages between the voltage V1 and the voltage V2 may be the same magnitude even in a case where the frame rates are different, or may be different magnitudes. The range of voltages may be set as appropriate in accordance with light emission characteristics of the light emission element 110.

For example, the light emission apparatus EQP may include a voltage value memory that stores the relationship of the frame rate and the range of voltages between the voltage V1 and the voltage V2. The voltage value memory, for example, may be disposed in the correction circuit 8000 illustrated in FIG. 8, in the control circuit 400, or independently. The reference voltage generation circuit 600 that constitutes the reference voltage generation unit may adjust the range of voltages between the voltage V1 and the voltage V2 based on the relationship stored in the voltage value memory.

In the present embodiment, the luminance for when displaying an image can be prevented from changing in accordance with the frame rate due to the leakage current of the write transistor 113. As a result, in the light emission apparatus EQP, it becomes possible to prevent image quality from degrading depending on the operation conditions and usage environment when operating the light emission apparatus EQP. Furthermore, by using the configuration described in the present embodiment, it is possible to reduce the change in luminance dependent on the frame rate without reducing the number of tones that can be represented in comparison to the above second embodiment.

In each of the above embodiments, a change in luminance due to a change in the frame rate for when images are displayed was described. However, even if the frame rate is the same, in a case where the chip temperature of the light emission apparatus EQP has changed, the amount of leakage current per unit of time of the write transistor 113 changes; therefore, the average electric potential that the capacitive element 109 holds changes, and a change in luminance occurs. A more specific method for adjusting the luminance that accords to a change in the temperature of the light emission apparatus EQP will be described below as a fourth embodiment of the light emission apparatus EQP. Here, points of difference from the above first to third embodiment will be mainly described, and description will be omitted for points that may be the same.

Figure 9:
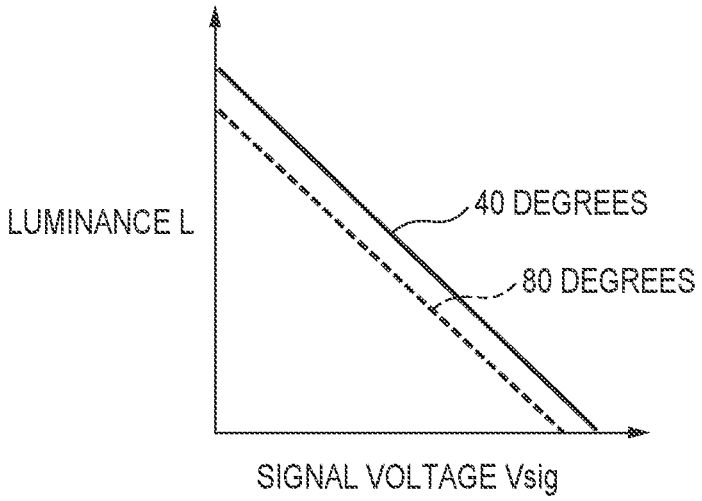
FIG. 9 is a view illustrating luminance characteristics of a pixel of the light emission apparatus of FIG. 1.

FIG. 9 is a graph illustrating a relationship (V-L characteristics) between the signal voltage Vsig, which represents the luminance of the light emission apparatus EQP, and actual luminance L of the light emission element 110. The horizontal axis is the luminance signal voltage Vsig, and the vertical axis is the luminance L. Cases where the chip temperature of the light emission apparatus EQP is 40 degrees and 80 degrees as parameters are disclosed. As is clear from FIG. 9, the signal voltage Vsig is larger in the case of 40 degrees than the case of 80 degrees in a case where the same luminance L is to be acquired. As described above, in a case where the temperature of the light emission apparatus EQP changed, if no measure is taken, the V-L characteristics of the light emission apparatus EQP will be different, and in a case where the same signal voltage Vsig is applied, deviation will occur in the luminance of a screen. In order to reduce the change in V-L characteristics due to the difference in the temperature of the light emission apparatus EQP, reduction of leakage current of the write transistor 113 and an increase in the capacitive element 109 of the pixels 101 can be considered. However, the size of the pixels 101 in the light emission apparatus EQP is miniaturized year by year, and the difficulty of correcting the change in V-L characteristics is high and also leads to an increase in development cost.

Figure 10:
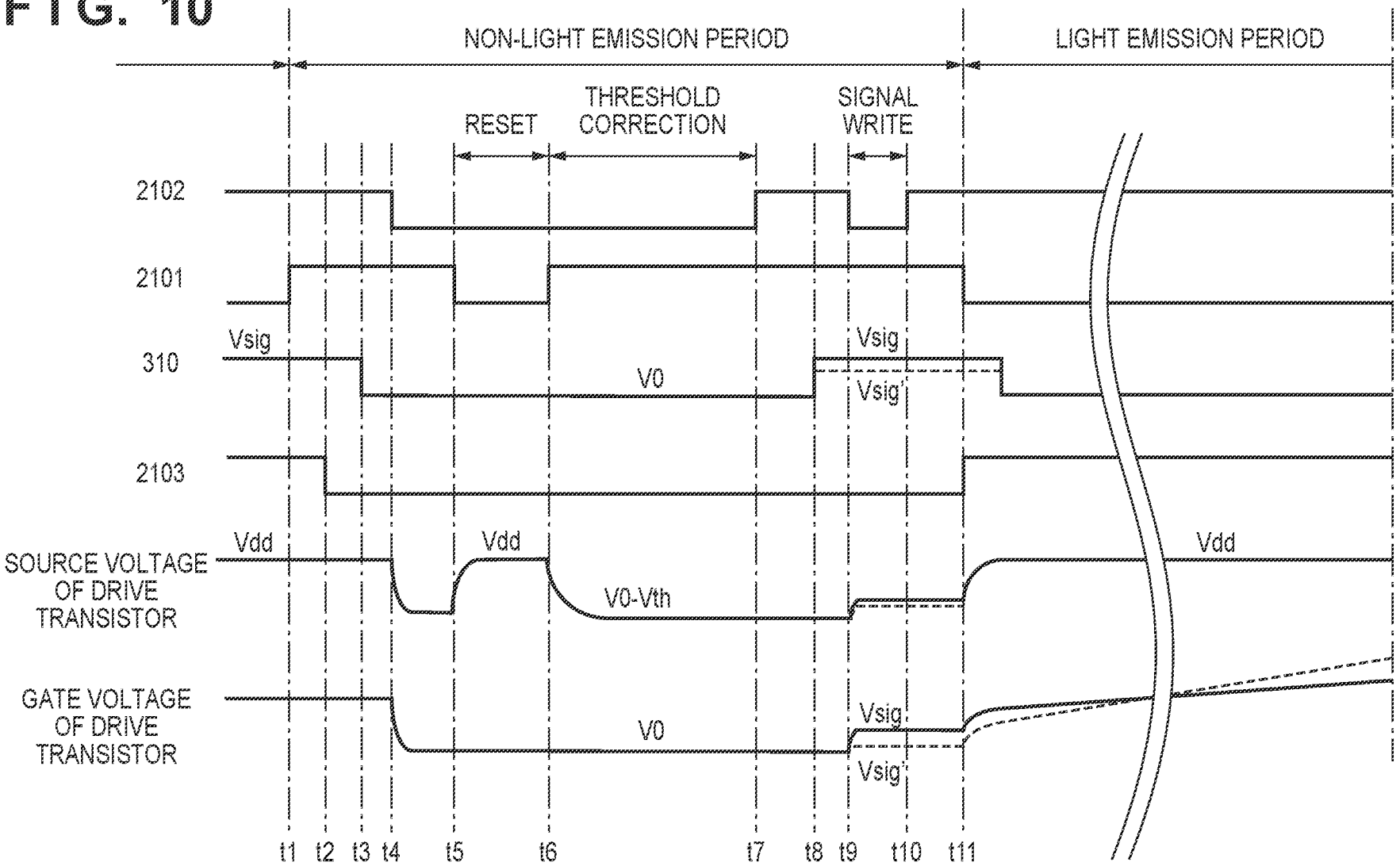
FIG. 10 is a timing chart describing an operation of the light emission apparatus of FIG. 1.

FIG. 10 is a timing chart for when the light emission apparatus EQP is caused to operate in the present embodiment. In order to facilitate understanding, the same notation has been used as the timing chart illustrated in FIG. 5. In FIG. 10, timings for a case where driving is performed at a frame rate of 60 Hz and a temperature of 80 degrees in addition to a case where driving is performed at a frame rate of 60 Hz and a temperature of 40 degrees of FIG. 5 are indicated.

In a case where the temperature is 80 degrees, the amount of leakage current of the write transistor 113 becomes larger than a case where the temperature is 40 degrees; therefore, the amount of change in the gate voltage that the capacitive element 109 holds increases. Accordingly, in order to adjust the average luminance, the signal supply unit, which includes the signal output circuit 300 and the reference voltage generation circuit 600 adjusts the signal voltage Vsig in accordance with the temperature as controlled by the control circuit 400. More specifically, as illustrated in FIG. 10, the signal voltage that is related to the image data inputted into the light emission apparatus EQP is changed from the signal voltage Vsig for a case where the temperature of the light emission apparatus EQP is 40 degrees to a signal voltage Vsig' for a case of 80 degrees. The signal voltage Vsig' is set to a value that is lower than the signal voltage Vsig.

In the present embodiment, the higher the temperature of the light emission apparatus EQP, the lower the level of the signal voltage Vsig is adjusted. In other words, in a case of a second temperature whose temperature is higher than a first temperature, it can be said that an offset amount related to the signal voltage Vsig that accords with the image data is more increased than the first temperature. Also, it can be said that in a case of the second temperature whose temperature is higher than the first temperature, the light emission element 110 is adjusted to emit light at a luminance that is higher than a luminance of the light emission element 110 in a case of the first temperature. By this, the luminance for when displaying an image can be prevented from changing in accordance with the temperature of the light emission apparatus EQP due to the leakage current of the write transistor 113. As a result, in the light emission apparatus EQP, it becomes possible to prevent image quality from degrading due to a temperature change depending on the operation conditions and usage environment when operating the light emission apparatus EQP.

The gate voltage Vg of the drive transistor 112 held in the capacitive element 109 is decided by the relationship of electric potentials of the reference voltage V0 and the signal voltage Vsig. Accordingly, the same effect is obtained even if the reference voltage V0 is adjusted in relation to the temperature of the light emission apparatus EQP. Accordingly, it is possible to select as appropriate the reference voltage V0 and the signal voltage Vsig as voltages to be adjusted. In the present embodiment, the higher the temperature, the more the level of the signal voltage Vsig is lowered; however, the present embodiment is not limited to this. It is sufficient that, by appropriately changing the level of voltage of the luminance signal in accordance with the temperature, luminance characteristics of the light emission apparatus EQP are maintained.

A more specific method for adjusting the luminance that accords to a change in the temperature of the light emission apparatus EQP will be described below as a fifth embodiment of the light emission apparatus EQP. Here, points of difference from the above fourth embodiment will be mainly described, and description will be omitted for points that may be the same.

FIG. 8 is a schematic view illustrating an example of a configuration of the light emission apparatus EQP in the present embodiment. The correction circuit 8000, which constitutes a correction unit for correcting image data supplied to the light emission apparatus EQP has been added to the light emission apparatus EQP of FIG. 1. The correction circuit 8000 is configured by a temperature measuring unit for measuring the temperature of the light emission apparatus EQP and the table memory (a correction value memory) that stores correction values that accord the temperatures of the light emission apparatus EQP. The table memory stores the correspondence relationship of the temperatures and correction values of the light emission apparatus EQP, outputs the correction value that corresponds to the temperature measured by the temperature measuring unit to the data processing circuit 500, and performs display setting. In the present embodiment, description will be made assuming that the temperature measuring unit is disposed in the correction circuit 8000; however, the present invention is not limited to this. If the relationship of the temperature of the light emission apparatus EQP and the luminance of the light emission element 110 can be obtained, the temperature measuring unit can be arranged at a suitable position in the light emission apparatus EQP.

As specific display setting, setting such as contrast and brightness can be given. Digital signal processing such as gamma correction, contrast adjustment, brightness adjustment are performed by the data processing circuit 500 on the image data inputted from outside the light emission apparatus EQP. Here, in the present embodiment, the correction circuit 8000 and the data processing circuit 500 constitute the correction unit. It can be said that the correction circuit 8000 in the correction unit includes a table memory correction value memory that stores correction values that accord with the temperature of the light emission apparatus EQP, and the data processing circuit 500 in the correction unit applies the correction value to the image data in accordance with the temperature of the light emission apparatus EQP. Also, it can be said that the above signal supply unit further includes the correction unit that includes the correction circuit 8000 and the data processing circuit 500.

Digital-to-analog conversion is performed by the signal output circuit 300 on the image data on which the digital signal processing was performed, and then the signal voltage Vsig is written into the gate electrode of the drive transistor 112 of the pixels 101. In other words, adjustment of the signal voltage Vsig can be performed by adjusting the contrast or brightness in accordance with the correction value of the table memory. For example, the correction unit (the correction circuit 8000 and the data processing circuit 500), in a case of the second temperature which is higher than the first temperature, may correct the luminance of the image data to a luminance that is higher than a luminance of the image data in a case of the first temperature.

In the present embodiment, the luminance for when displaying an image can be prevented from changing in accordance with the temperature of the light emission apparatus EQP due to the leakage current of the write transistor 113. As a result, in the light emission apparatus EQP, it becomes possible to prevent image quality from degrading due to a temperature change depending on the operation conditions and usage environment when operating the light emission apparatus EQP.

A more specific method for adjusting the luminance that accords to a change in the temperature of the light emission apparatus EQP will be described below as a sixth embodiment of the light emission apparatus EQP. Here, points of difference from the above fourth and fifth embodiment will be mainly described, and description will be omitted for points that may be the same.

With the adjustment method described in the above fifth embodiment, because correction of image data is performed by digital signal processing, the number of tones that the light emission apparatus EQP can represent is limited. For example, if contrast is doubled in image data that was representing at 1024 tones, the image data can be represented only at 512 tones. Accordingly, in the present embodiment, by adjusting the signal voltage Vsig by the analog voltage, the limitation of the number of tones can be resolved.

Specifically, the reference voltage generation circuit 600, which is the reference voltage generation unit, generates the plurality of reference voltages Vref that accords with the number of tones of the image data and supplies the column DAC circuit 302, which constitutes the output unit. The column DAC circuit 302 converts the image data to an analog voltage and supplies the result as the signal voltage Vsig to the signal line 310 via the column driver circuit 303, which constitutes the output unit. In other words, by adjusting the analog reference voltage Vref of the reference voltage generation circuit 600, the signal voltage Vsig can be adjusted.

As described above, the reference voltage generation circuit 600 generates a plurality of reference voltages in a range of voltages between the voltage V1 and the voltage V2 for which the luminance of the light emission element 110 is lower than the voltage V1. For example, in a case of performing a display of 1024 tones, the reference voltage generation circuit 600 generates voltages, which are a range of voltages between the voltage V1 and the voltage V2 divided into 1024, as the respective reference voltages Vref. In a case of adjusting the luminance in accordance with the temperature of the light emission apparatus EQP, only the voltage V1 may be adjusted. For example, in a case of the second temperature whose temperature is higher than the first temperature, the light emission element 110 may be changes the voltage V1 to a voltage that emits light at a luminance that is higher than a luminance of the light emission element 110 in a case of the first temperature. However, in a case of adjusting only the voltage V1, gamma characteristic of the light emission apparatus EQP will degrade; therefore, not only the voltage V1 but also the voltage V2 may be adjusted at the same time. For example, in a case of the second temperature whose temperature is higher than the first temperature, the light emission element 110 may be changes the voltage V2 to a voltage that emits light at a luminance that is higher than a luminance of the light emission element 110 in a case of the first temperature. At this time, for example, the range of voltages between the voltage V1 and the voltage V2 may be the same magnitude even in a case where the temperatures are different, or may be different magnitudes. The range of voltages may be set as appropriate in accordance with light emission characteristics of the light emission element 110.

For example, the light emission apparatus EQP may include a voltage value memory that stores the relationship of the temperature of the light emission apparatus EQP and the range of voltages between the voltage V1 and the voltage V2. The voltage value memory, for example, may be disposed in the correction circuit 8000 illustrated in FIG. 8, in the control circuit 400, or independently. The reference voltage generation circuit 600 that constitutes the reference voltage generation unit may adjust the range of voltages between the voltage V1 and the voltage V2 based on the relationship stored in the voltage value memory.

In the present embodiment, the luminance for when displaying an image can be prevented from changing in accordance with the frame rate due to the leakage current of the write transistor 113. As a result, in the light emission apparatus EQP, it becomes possible to prevent image quality from degrading due to a temperature change depending on the operation conditions and usage environment when operating the light emission apparatus EQP. Furthermore, by using the configuration described in the present embodiment, it is possible to reduce the change in luminance dependent on the temperature of the light emission apparatus EQP without reducing the number of tones that can be represented in comparison to the above fifth embodiment.

It was described in the above first to third embodiment that the signal voltage Vsig was changed in accordance with the change in the frame rate for when displaying images and in the fourth to sixth embodiments that the signal voltage Vsig was changed in accordance with the change in the temperature of the light emission apparatus EQP. However, the present invention is not limited to this and may change the signal voltage Vsig in accordance with both a change in the frame rate and a change in the temperature of the light emission apparatus EQP. In other words, the above first to third embodiments and fourth to sixth embodiments may be combined as appropriate.

The light emission apparatus EQP which includes a circuit for estimating leakage current in an off state of the write transistor 113 in order to adjust luminance in accordance with changes in the frame rate for when displaying images and the temperature of the light emission apparatus EQP will be described below as a seventh embodiment. Here, points of difference from the above first to sixth embodiments will be mainly described, and description will be omitted for points that may be the same.

FIG. 8 is a schematic view illustrating an example of a configuration of the light emission apparatus EQP in the present embodiment. The correction circuit 8000, which constitutes a correction unit for correcting image data supplied to the light emission apparatus EQP has been added in relation to the light emission apparatus EQP of FIG. 1. The correction circuit 8000 includes a leakage current estimation circuit for estimating leakage current in an off state of the write transistor 113.

The leakage current estimation circuit is configured by, for example, a transistor for estimating leakage current, a current integration circuit, and an ADC. The transistor for estimating leakage current may be of the same planar layout and the same electric potential relationship as the write transistor 113. The transistor for estimating leakage current is made to be in an off state, and the main terminal is connected to the input of the current integration circuit. The current integration circuit is controlled by the control circuit 400 so as to end an integration operation in one frame. The output of the current integration circuit is connected to the ADC and then is AD converted. Because the leakage current of when the transistor for estimating leakage current is off during a period of one frame is integrated by the integration circuit, the size of leakage current of the write transistor 113 of the pixel 101 can be estimated using the output of the leakage current estimation circuit. The signal supply unit adjusts the signal voltage in accordance with the leakage current of the transistor for estimating leakage current for when the transistor for estimating leakage current is operated. The method of adjusting the signal voltage may be such that the correction circuit 8000 includes the table memory (correction value memory) that stores the correction values that accord with the amount of leakage current estimated by the leakage current estimation circuit and corrects the image data in the data processing circuit 500 as in the above second and fifth embodiments. Also, the reference voltages Vref that the reference voltage generation circuit 600 generates may be changed in accordance with the amount of leakage current estimated by the leakage current estimation circuit as in the third and sixth embodiments. Regarding the transistor for estimating leakage current, because the integration amount of leakage current changes in accordance with the temperature and the frame rate, using the output of the leakage current estimation circuit makes it possible to perform setting of the signal voltage Vsig that accords with the changes in the frame rate for when displaying images and the temperature of the light emission apparatus EQP.

In the present embodiment, the luminance for when displaying an image can be prevented from changing in accordance with the temperature of the light emission apparatus EQP due to the leakage current of the write transistor 113. As a result, in the light emission apparatus EQP, it becomes possible to prevent image quality from degrading due to a temperature change depending on the operation conditions and usage environment when operating the light emission apparatus EQP. Furthermore, each of the above embodiments needs to estimate a correction value from the parameters of the frame rate for when displaying images or the temperature of the light emission apparatus EQP. Meanwhile, by virtue of the configuration of the present embodiment, because the change in amount of leakage current of the transistor that accords with the frame rate for when displaying images and the temperature of the light emission apparatus EQP is obtained by measuring, it becomes possible to perform more accurate correction. Also, the above first to sixth embodiments and the present embodiment may be combined as appropriate.

Light emission apparatuses EQP such as the above may be embedded in various electronic devices. As such electronic devices, a camera, a computer, a mobile terminal, an onboard display apparatus, and the like, for example, can be given. An electronic device may include, for example, a light emission apparatus EQP and a control unit that controls driving of the light emission apparatus EQP.

Figure 11:
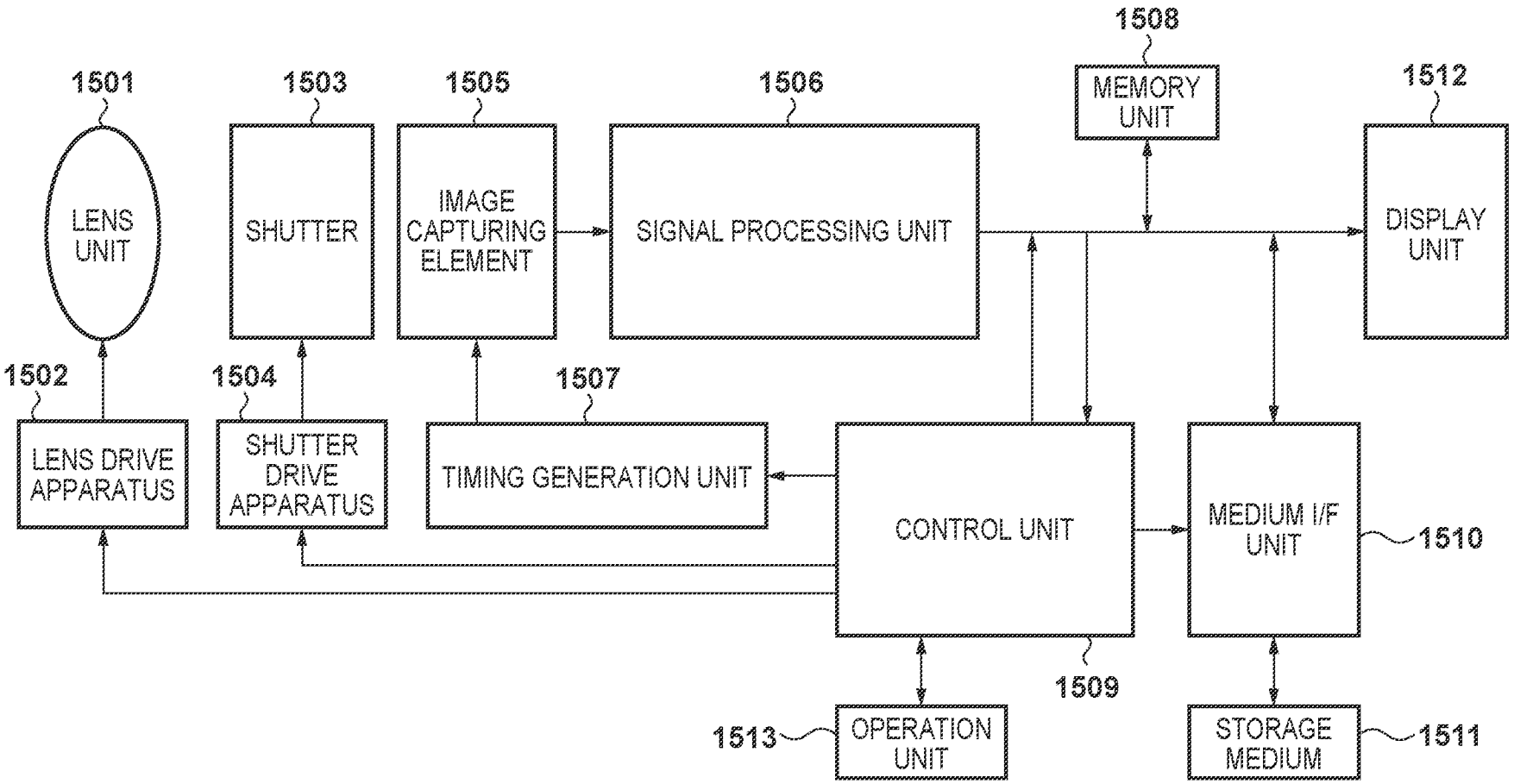
FIG. 11 is a block diagram illustrating an example of a configuration of an electronic device that uses the light emission apparatus of FIG. 1.

Here, an embodiment that has adopted the above light emission apparatus EQP as a display unit of a digital camera will be described using FIG. 11. A lens unit 1501 is an image capturing optical system that causes an image capturing element 1505 to form an optical image of a subject and has a focus lens, a zoom lens, a diaphragm, and the like. Driving of the focus lens position, the zoom lens position, the aperture of the diaphragm, and the like in the lens unit 1501 is controlled by a control unit 1509 via a lens drive apparatus 1502.

A mechanical shutter 1503 is positioned between the lens unit 1501 and the image capturing element 1505, and driving is controlled by the control unit 1509 via a shutter drive apparatus 1504. The image capturing element 1505 converts the optical image formed in the lens unit 1501 by a plurality of pixels into image signals. A signal processing unit 1506 performs an A/D conversion, demosaicing processing, white balance adjustment processing, encoding processing and the like on the image signal outputted from the image capturing element 1505.

A timing generation unit 1507 outputs various timing signals to the image capturing element 1505 and the signal processing unit 1506. The control unit 1509 has, for example, memories (ROM, RAM) and a microprocessor (CPU) and realizes various functions of the digital camera by controlling each unit by loading the programs stored in the ROM to the RAM and having the CPU execute the programs. The functions realized by the control unit 1509 include automatic focus detection (AF) and automatic exposure control (AE).

A memory unit 1508 is used by the control unit 1509 and the signal processing unit 1506 to temporarily store image data or as a work area. A medium OF unit 1510 is an interface for reading and writing a storage medium 1511, which is, for example, a detachable memory card. A display unit 1512 displays captured images and various kinds of information of the digital camera. The above light emission apparatus EQP can be applied to the display unit 1512. The light emission apparatus EQP provided on the digital camera as the display unit 1512 is driven by the control unit 1509 and displays images and various kinds of information. An operation unit 1513 is a user interface such as a power switch, a release button, and a menu button and is for the user to perform instructions and setting for the digital camera.

Next, an operation of the digital camera for when capturing will be described. When the power is turned on, a shooting standby state is entered. The control unit 1509 starts moving image shooting processing and display processing for causing the display unit 1512 (the light emission apparatus EQP) to operate as an electronic viewfinder. When an imaging preparation instruction (e.g., a half press of the release button of the operation unit 1513) is inputted in the shooting standby state, the control unit 1509 starts focus detection processing.

Then, the control unit 1509 obtains the amount of movement and direction of movement of the focus lens of the lens unit 1501 from the acquired amount of defocus and direction, drives the focus lens via the lens drive apparatus 1502, and adjusts the focus of the image capturing optical system. After the driving, focus detection based on a contrast evaluation value may be further performed as necessary and the focus lens position may be finely adjusted.

Then when a shooting start instruction (e.g., a full press of the release button) is inputted, the control unit 1509 executes a shooting operation for recording, processes the acquired image data in the signal processing unit 1506, and stores the result in the memory unit 1508. Then the control unit 1509 stores the image data stored in the memory unit 1508 in the storage medium 1511 via the medium OF unit 1510. Also, the control unit 1509, at this time, may drive the display unit 1512 (the light emission apparatus EQP) so as to display the captured image. The control unit 1509 may output image data from an external OF unit (not shown) to an external device such as a computer.

By virtue of the present invention, a technique that is advantageous for preventing degradation of image quality in a light emission apparatus can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-093676, filed May 28, 2020 which is hereby incorporated by reference herein in its entirety.

What is claimed is:

1. A light emission apparatus comprising:

a plurality of pixels each comprising a light emission element; and a signal supply unit that supplies to each of the plurality of pixels a signal voltage that is in accordance with inputted image data, wherein each of the plurality of pixels further comprises (1) a first transistor configured to control an amount of current that flows in the light emission element, and (2) a second transistor disposed between a signal line on which the signal voltage is supplied from the signal supply unit and a gate electrode of the first transistor, the second transistor being configured to write a voltage in accordance with the signal voltage input from the signal supply unit through the signal line to the gate electrode when the second transistor is in an on state, and wherein the signal supply unit changes a value of the signal voltage in accordance with a frame rate.

2. The light emission apparatus according to claim 1, wherein the signal supply unit, in a case of a second frame rate whose frame rate is lower than a frame rate of a first frame rate, increases an offset amount related to the signal voltage more than an offset amount related to the signal voltage in a case of the first frame rate.

3. The light emission apparatus according to claim 2, wherein the signal supply unit, in a case of the second frame rate, adjusts so that a luminance of light emitted from the light emission element is higher than a luminance of light emitted from the light emission element in a case of the first frame rate.

4. The light emission apparatus according to claim 2, wherein the signal supply unit includes (a) a reference voltage generation unit that generates a plurality of reference voltages in accordance with the number of tones of the image data, and (b) an output unit for outputting one of reference voltage among the plurality of reference voltages as the signal voltage to the signal line in accordance with the image data, and wherein the reference voltage generation unit (a) generates the plurality of reference voltages in a range of voltages between a first voltage and a second voltage whose luminance of the light emission element is lower than the first voltage, and (b) changes, in a case of the second frame rate, the first voltage to a voltage at which the light emission element emits light at a luminance that is higher than a luminance of the light emission element in a case of the first frame rate.

5. The light emission apparatus according to claim 4, wherein the reference voltage generation unit changes, in a case of the second frame rate, the second voltage to a voltage at which the light emission element emits light at a luminance that is higher than a luminance of the light emission element in a case of the first frame rate.

6. The light emission apparatus according to claim 4, further comprising: a voltage value memory configured to store a relationship of a frame rate and the range of voltages, wherein the reference voltage generation unit, based on the relationship, adjusts the range of voltages.

7. The light emission apparatus according to claim 2, wherein the signal supply unit further comprises a correction unit for correcting the image data, and wherein the correction unit, in a case of the second frame rate, corrects a luminance of the image data to a luminance that is higher than a luminance of the image data in a case of the first frame rate.

8. The light emission apparatus according to claim 7, wherein the correction unit (a) includes a correction value memory that stores a correction value that accords with a frame rate and (b) applies the correction value to the image data in accordance with a frame rate.

9. The light emission apparatus according to claim 1, wherein the signal supply unit (a) adjusts, in accordance with the temperature of the light emission apparatus, the signal voltage, and (b) adjusts, in a case of a second temperature whose temperature is higher than a first temperature, the signal voltage to a voltage at which the light emission element emits light at a luminance that is higher than a luminance of the light emission element in the case of the first temperature.

10. The light emission apparatus according to claim 1, further comprising:

a third transistor configured to estimate leakage current in an off state of the second transistor, wherein the signal supply unit, in accordance with a leakage current of the third transistor when the third transistor is operated, adjusts the signal voltage.

11. The light emission apparatus according to claim 9, further comprising:

a temperature measuring unit configured to measure a temperature of the light emission apparatus.

12. A light emission apparatus comprising:

a plurality of pixels each comprising a light emission element; and a signal supply unit that supplies to each of the plurality of pixels a signal voltage that is in accordance with inputted image data, wherein each of the plurality of pixels further comprises (1) a first transistor configured to control an amount of current that flows in the light emission element, and (2) a second transistor disposed between a signal line on which the signal voltage is supplied from the signal supply unit and a gate electrode of the first transistor, the second transistor being configured to write a voltage in accordance with the signal voltage input from the signal supply unit through the signal line to the gate electrode when the second transistor is in an on state, and wherein the signal supply unit changes a value of the signal voltage in accordance with a temperature of the light emission apparatus.

13. The light emission apparatus according to claim 12, wherein the signal supply unit, in a case of the second temperature, adjusts so that the light emission element emits light at a luminance that is higher than a luminance of the light emission element in a case of the first temperature.

14. The light emission apparatus according to claim 12, further comprising:

a temperature measuring unit configured to measure a temperature of the light emission apparatus.

15. The light emission apparatus according to claim 12, wherein the signal supply unit includes (a) a reference voltage generation unit that generates a plurality of reference voltages in accordance with the number of tones of the image data, and (b) an output unit for outputting to the signal line as the signal voltage one reference voltage among the plurality of reference voltages in accordance with the image data, and wherein the reference voltage generation unit (a) generates the plurality of reference voltages in a range of voltages between a first voltage and a second voltage whose luminance of the light emission element is lower than the first voltage, and (b) changes, in a case of the second temperature, the first voltage to a voltage at which the light emission element emits light at a luminance that is higher than a luminance of the light emission element in a case of the first temperature.

16. The light emission apparatus according to claim 15, wherein the reference voltage generation unit changes, in a case of the second temperature, the second voltage to a voltage at which the light emission element emits light at a luminance that is higher than a luminance of the light emission element in a case of the first temperature.

17. The light emission apparatus according to claim 15, further comprising:

a voltage value memory configured to store a relationship of a temperature of the light emission apparatus and the range of voltages, wherein the reference voltage generation unit, based on the relationship, adjusts the range of voltages.

18. The light emission apparatus according to claim 12, wherein the signal supply unit further comprises a correction unit for correcting the image data, and wherein the correction unit, in a case of the second temperature, corrects a luminance of the image data to a luminance that is higher than a luminance of the light emission element in a case of the first temperature.

19. The light emission apparatus according to claim 18, wherein the correction unit (a) includes a correction value memory that stores a correction value that accords with a temperature of the light emission apparatus and (b) applies the correction value to the image data in accordance with the temperature of the light emission apparatus.

20. A light emission apparatus comprising:

a plurality of pixels each comprising a light emission element; and a signal supply unit that supplies to each of the plurality of pixels a signal voltage that is in accordance with inputted image data, wherein each of the plurality of pixels further comprises (1) a first transistor configured to control an amount of current that flows in the light emission element, and (2) a second transistor disposed between a signal line on which the signal voltage is supplied from the signal supply unit and a gate electrode of the first transistor, the second transistor being configured to write a voltage in accordance with the signal voltage input from the signal supply unit through the signal line to the gate electrode the signal voltage, wherein the light emission apparatus further comprises a third transistor configured to estimate leakage current in an off state of the second transistor, and wherein the signal supply unit, in accordance with the leakage current of the third transistor when the third transistor is operated, adjusts the signal voltage.

21. An electronic device comprising:

the light emission apparatus according to claim 1; and a control unit configured to control driving of the light emission apparatus.

22. The light emission apparatus according to claim 12, wherein the signal supply unit, in a case of a second temperature whose temperature is higher than a first temperature, increases an offset amount related to the signal voltage that is in accordance with the image data more than in a case of the first temperature.

23. The light emission apparatus according to claim 20, wherein the signal supply unit, in accordance with the leakage current of the third transistor when the third transistor is operated, changes a value of the signal voltage.

* * * * *